US010477987B2

(12) United States Patent
White

(10) Patent No.: US 10,477,987 B2
(45) Date of Patent: Nov. 19, 2019

(54) ADVERTISING PANEL AND METHOD FOR MOUNTING TO A SURFACE

(71) Applicant: K-International, Inc., Waukegan, IL (US)

(72) Inventor: Michael J. White, Ripon, WI (US)

(73) Assignee: K-International, Inc., Waukegan, IL (US)

( * ) Notice: Subject to any disclaimer, the term of this patent is extended or adjusted under 35 U.S.C. 154(b) by 0 days.

(21) Appl. No.: 15/927,260

(22) Filed: Mar. 21, 2018

(65) Prior Publication Data

US 2019/0290022 A1 Sep. 26, 2019

(51) Int. Cl.

| | |
|---|---|
| ***A47F 5/08*** | (2006.01) |
| *G09F 7/10* | (2006.01) |
| *G09F 7/18* | (2006.01) |
| *G09F 7/12* | (2006.01) |

(52) U.S. Cl.

CPC ..... *A47F 5/0807* (2013.01); *G09F 7/10* (2013.01); *G09F 7/12* (2013.01); *G09F 2007/122* (2013.01); *G09F 2007/1847* (2013.01)

(58) Field of Classification Search

CPC .... A47F 5/0807; G09F 7/10; G09F 2007/122; G09F 2007/1847; F09F 7/12

See application file for complete search history.

(56) References Cited

U.S. PATENT DOCUMENTS 4,171,584 A * 10/1979 Kaiser ..... G09F 7/10 40/109
4,973,170 A * 11/1990 Bescherer ..... G01K 1/14 374/109
5,318,262 A * 6/1994 Adams ..... F16B 47/00 248/205.8
5,351,841 A * 10/1994 Belokin ..... A47F 5/08 211/88.01
6,143,391 A * 11/2000 Barnes ..... F16B 47/00 248/205.8
6,375,143 B1 * 4/2002 Burns ..... F16B 47/00 160/370.21

(Continued)

OTHER PUBLICATIONS

The Revolutionary Cooler Display, by Cooler Display Inc., printed from website www.CoolerDisplay.com on Sep. 18, 2015, one page.

(Continued)

*Primary Examiner* — Ko H Chan
(74) *Attorney, Agent, or Firm* — Schiff Hardin LLP

(57) ABSTRACT

An advertising panel for attaching to a glass door or other surface includes a panel body with a front surface configured for holding advertising material or other display. End caps are mounted on the ends of the panel body. Each end cap includes two arms extending into a channel in the panel body. The arms include grasping portions that receive a square stem of a suction cup. The suction cup extends out of the channel at a slot that is open at the back of the panel body. The cup portion of the suction cups is enclosed behind the panel body when attached to the surface. A release tab of each suction cup extends from the panel body at cut out portions of the end caps. The arm lengths maintain the release tabs at a position extending from the end caps and prevent rotation of the suction cups.

17 Claims, 7 Drawing Sheets

(56) References Cited

U.S. PATENT DOCUMENTS

| | | | | |
|---|---|---|---|---|
| 6,446,375 | B1 * | 9/2002 | Davis | G09F 3/20 40/591 |
| 6,658,775 | B1 * | 12/2003 | Lanzisero | G09F 3/203 40/593 |
| 6,772,884 | B2 * | 8/2004 | Mathiez | A45D 40/0087 206/581 |
| 6,948,272 | B1 | 9/2005 | Olivier et al. | |
| 6,962,038 | B2 * | 11/2005 | Mathiez | A45D 40/0087 53/453 |
| 7,383,654 | B2 | 6/2008 | Olivier et al. | |
| 8,186,308 | B1 * | 5/2012 | Hluben | A01K 13/001 119/676 |
| 8,819,971 | B2 | 9/2014 | English | |
| 2001/0020621 | A1 * | 9/2001 | Immerman | A47K 3/281 220/483 |
| 2005/0093510 | A1 * | 5/2005 | Seil | H01M 2/1055 320/114 |
| 2014/0363038 | A1 * | 12/2014 | Coleman | G09F 21/048 381/333 |
| 2015/0026898 | A1 * | 1/2015 | Arvinte | A47L 13/022 7/105 |
| 2018/0064265 | A1 * | 3/2018 | Shea | A47F 5/0823 |

OTHER PUBLICATIONS

Cooler Display, by Cooler Display Inc., instruction sheet for mounting cooler display piece to cooler door handle, published prior to Feb. 16, 2018, one page.

Wall/Shelf/Glass Brackets & Arms for Sign Grips, by T M Shea Products, catalog supplement p. 18, published 2016, one page.

Plastic Crescent Signs, by T M Shea Products, catalog supplement p. 16 and unnumbered page, published 2016, two pages.

AdHandles™ by Ad Handle, by Ad Handle Group, printed from website www.adhandle.com on Oct. 15, 2014, two pages.

Co-pending U.S. Appl. No. 15/651,833, filed Jul. 17, 2017.

* cited by examiner

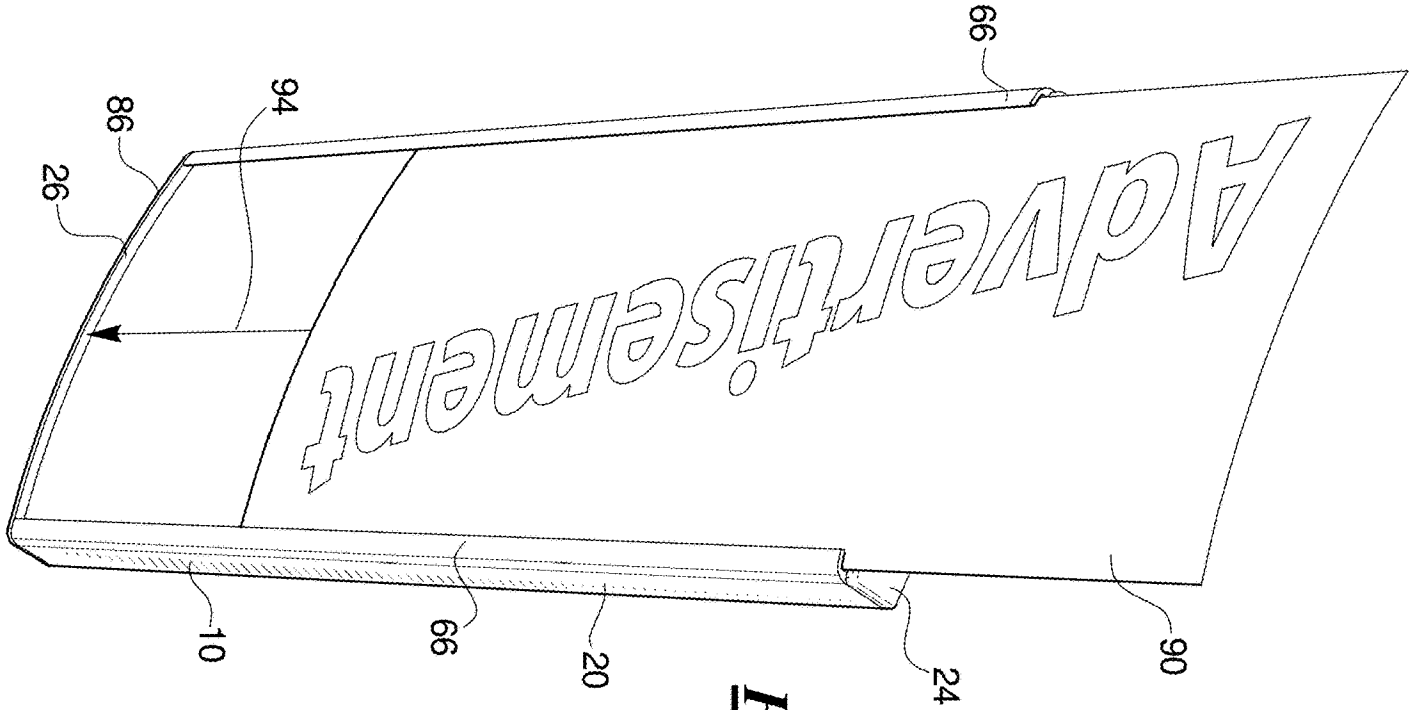
FIG. 9
FIG. 8
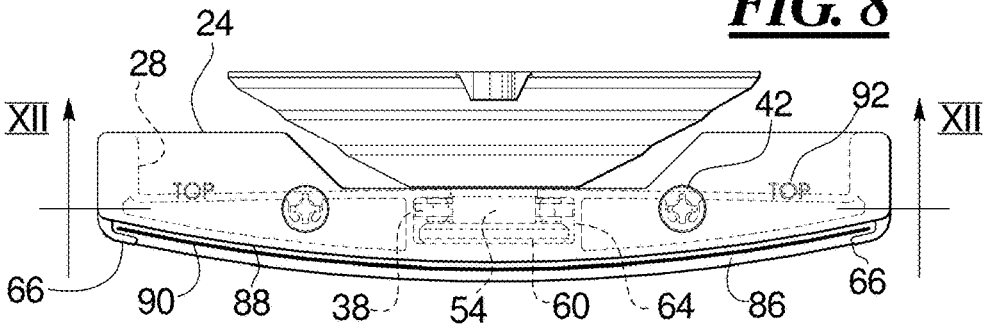

ADVERTISING PANEL AND METHOD FOR MOUNTING TO A SURFACE

BACKGROUND OF THE INVENTION

Field of the Invention

The present invention relates generally to an apparatus and method for mounting to a surface, and in particular to an advertising panel and method for mounting to a surface.

Description of the Related Art

Coolers are commonly provided in convenience stores, grocery stores, snack shops, delicatessens, ice cream shops, general merchandise or supercenter stores, gas stations, liquor stores, bait shops, and other locations for dispensing cold or cooled beverages and foods, bagged and block ice, bait, or other chilled items. Such coolers commonly have one or more glass doors through which the cooled items may be seen by a customer, although opaque doors are provided on some coolers. The door usually has a handle that the customer may grasp to open the door and retrieve the cooled beverage, food item or other cooled item.

Customers choosing items from a cooler may be influenced in their selection by advertising to promote a product, announce a sale, tout a new product, or provide another message to the customer. Advertising placed near to the product may be more effective than advertising that is located elsewhere in the store. One approach that has been tried is locating the advertising on the door handle of the cooler. Door handle advertising may be particularly effective as it may be one of the last things that the customer looks at before making a selection from the cooler. However, existing coolers have door handles in a wide variety of sizes, shapes, materials, and styles, and may be of a wide range of vintages, including legacy door handles on older coolers. For example, some coolers are provided with lever type handles that must be pivoted out or down to unlatch the door, while others handles are configured for pulling open a hinged door held by a magnetic latch, and yet others include handles for sliding open a sliding cooler door.

Mounting of the advertising to the cooler door handle has proven problematic. The handles provided on the coolers may be of different shapes, sizes, or thicknesses, and may be an open handle type that can be encircled by the user's hand or may be of a closed handle type such as channel or pocket handle into which or behind which the user's fingers are inserted to open the door. A mount that may work for one type of handle may not fit onto another type of handle. The advertising may become loose on the handle, may come off, or may interfere with use of the handle. Fastening the advertising to the handle may even result in damage to the handle or to the door.

SUMMARY OF THE INVENTION

The present method and apparatus provides an advertising panel that may be attached to a surface. In certain examples, the advertising panel may be attached to or near a cooler door and may be located near to the handle of the cooler door. Other mounting locations are of course possible.

The advertising panel includes a panel body having a portion for holding advertising material or other display or information. At least one end cap is fastened to the panel body. The end cap includes at least one arm that extends into a channel of the panel body. The arm engages a suction cup.

The arm positions the suction cup so that a release tab on the suction cup extends from the panel body and so that the cup portion of the suction cup is behind the panel body when the advertising panel is attached to a surface. The panel body may be configured for covering the suction cup when it is engaged to the surface, except for the release tab.

In certain embodiments, the advertising panel may have two end caps on opposite ends and may include two suction cups for attaching the advertising panel to a surface. Both end caps may include one or more arms that position the suction cups so that release tabs on the suction cups extend from behind the panel body.

BRIEF DESCRIPTION OF THE DRAWINGS

FIG. 8 is a top plan view of the advertising panel;

FIG. 9 is a perspective view from the top, front, right side of the advertising panel showing advertising material or other display being inserted into the advertising panel;

DETAILED DESCRIPTION OF THE PREFERRED EMBODIMENTS

Figure 1:
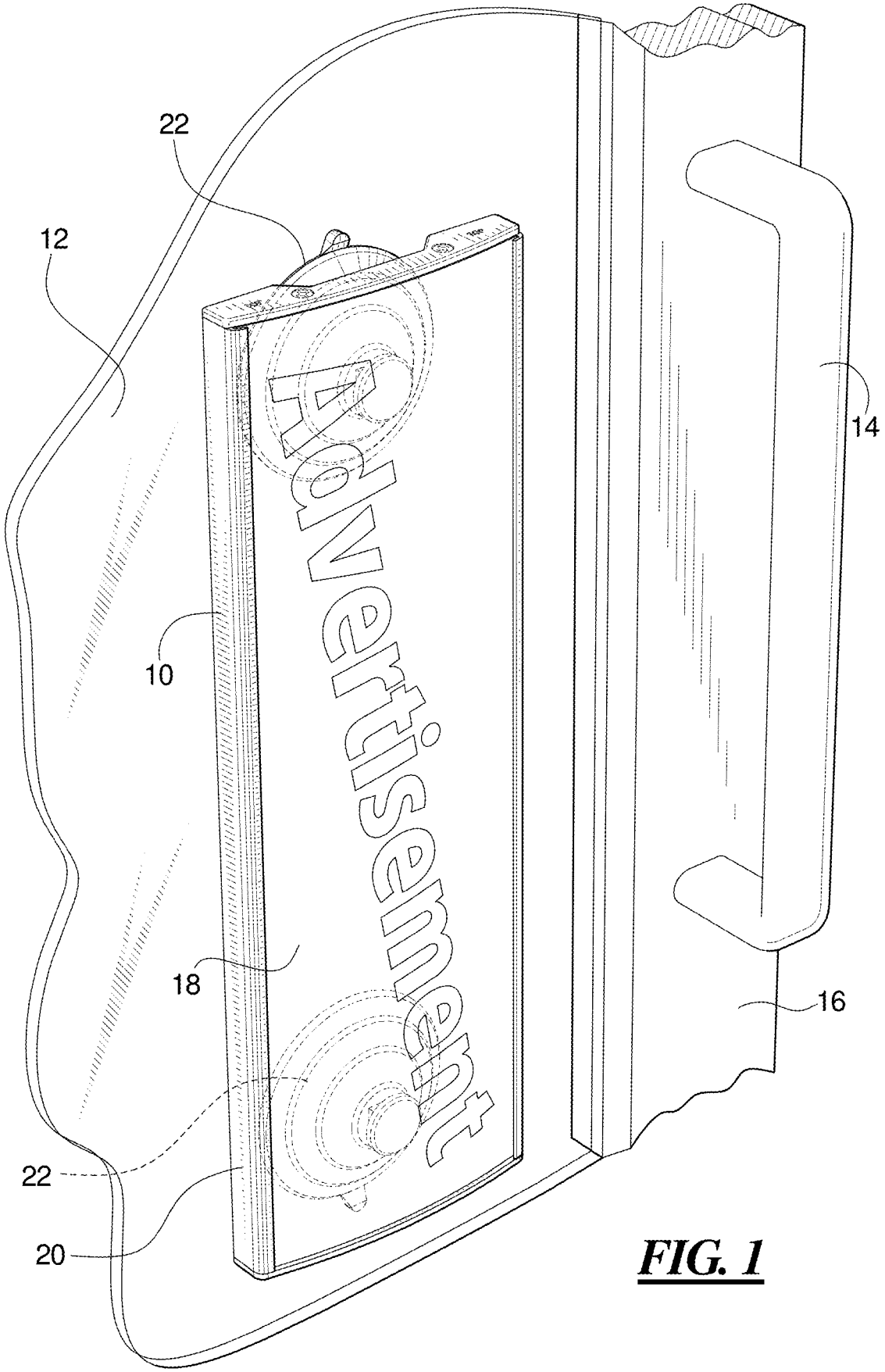
FIG. 1 is a perspective view from the top, front, left side of an advertising panel shown mounted to a surface adjacent to a door handle, as an example of a use of the advertising panel.

In FIG. 1, an advertising panel 10 is mounted on a surface 12 adjacent to a handle 14. The surface 12 may be a glass surface of a cooler door or other non-porous surface. In the illustration, the advertising panel 10 is mounted on the door surface adjacent to the handle 14 that is used by customers to open the cooler to select chilled beverages, foods, or other chilled or frozen items. As the customer reaches for the door handle to open the door and retrieves their desired item, advertising material or other display on the advertising panel 10 is in the user's field of view, located adjacent the handle 14. The user may make a selection or may change to another item based on advertising material, information, or other material or display provided on the advertising panel 10.

The advertising panel 10 may be mounted on the glass surface 12 of the cooler door adjacent a frame 16 of the door. The advertising panel 10 may instead be mounted on the frame 16. The advertising panel 10 may be mounted on a window, exterior or interior door, wall, pillar, cabinet, counter, shelf, desk, panel, or other non-porous surface as desired.

The advertising panel 10 includes a front surface 18 on which is provided advertising; product or price information; one or more images, logos, or directions; promotional information; announcements; displays; or other information as desired. The front surface 18 is provided on a panel body 20 that is mounted to the surface 12 by suction cups 22. Although the panel 10 is referred to as an advertising panel that displays advertising material, other materials, other information, or other displays may be displayed. The present method and apparatus is not limited to the display of advertising.

The illustrated advertising panel 10 provides information to potential customers and others via printed advertising material. It is contemplated to provide lights or sounds or both in the advertising panel 10. For example, the advertising panel 10 may be back lit or may incorporate lights such as LED lights in the display. The back lighting or lights may be activated by a motion sensor in the advertising panel 10. The advertising panel 10 may output an audio signal, such as a voice, music, or sounds. For example, the advertising panel 10 may play a voice announcing a sale on a product or play a jingle or other tune or music when activated by motion. A display screen such as a liquid crystal or electronic paper display may be provided on the advertising panel 10 for an easily updated display and possibly for display of an animation or video information. A battery, a motion sensor, and operating circuitry may be provided in the advertising panel 10 to power and control the lights, sounds, and display.

Figure 2:
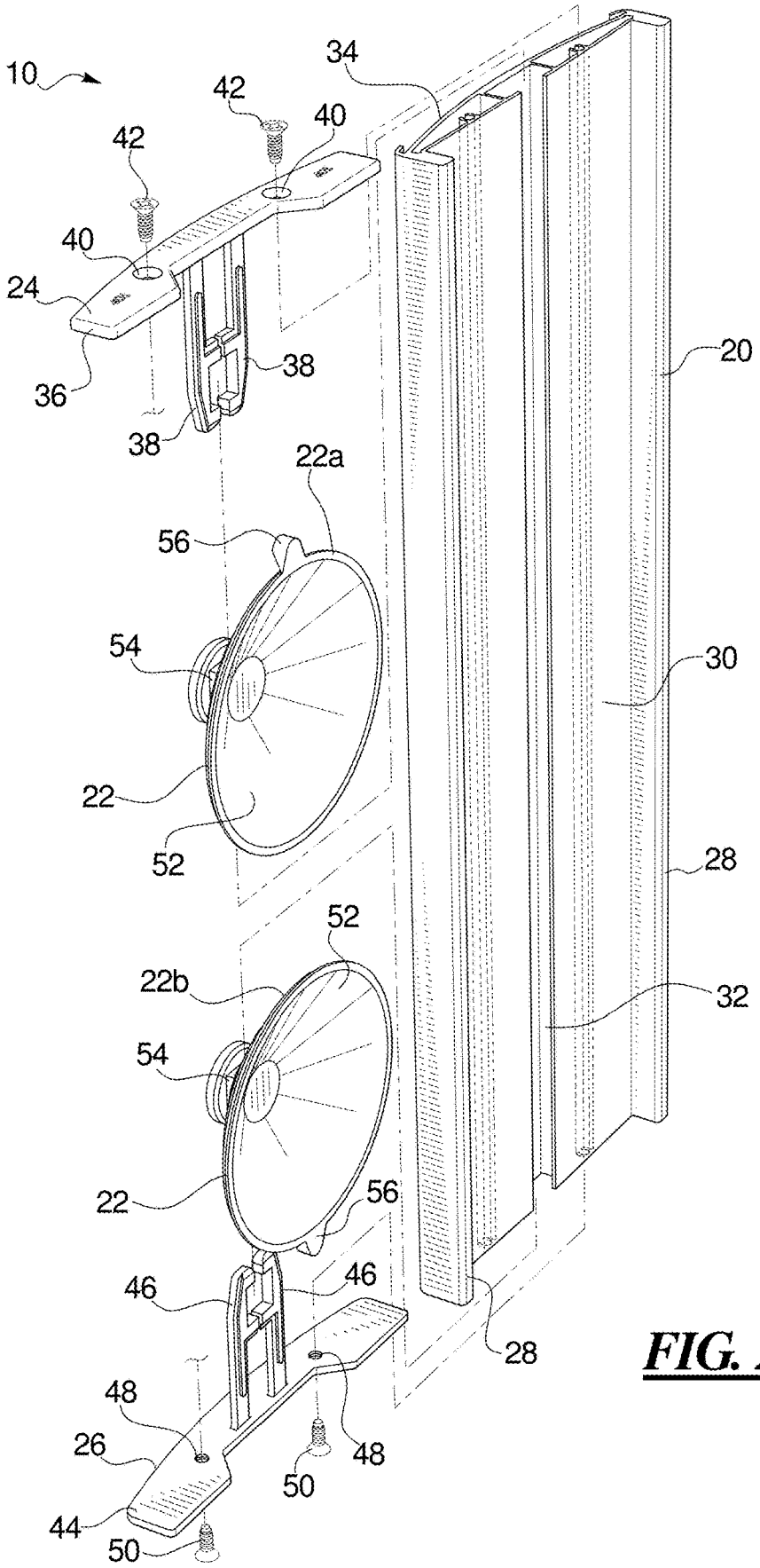
FIG. 2 is an exploded view of the advertising panel, shown in a perspective view from the top, back, right side.

Turning to FIG. 2, the advertising panel 10 includes the panel body 20 to which is fastened top and bottom end caps 24 and 26 and in which is mounted the suction cups 22. The panel body 20 is formed of an extrusion that includes side walls 28, a back panel 30 which defines a center slot 32, and a front panel 34. Additional features of the panel body 20 will be discussed in conjunction with other figures. The top end cap 24 includes a planar cap portion 36 from which extends a pair of arms 38. The arms 38 are closely adjacent to one another but are separate from one another. A pair of recessed or counter-sunk openings 40 receive a pair of screws 42, which may be machine screws or metal screws.

The bottom end cap 26 is of a similar configuration but differs from the top end cap 24 to permit advertising to be fastened to the panel body 20 from one end but not the other. The bottom end cap 26 has a planar cap portion 44, a pair of arms 46 extending from the planar cap portion 44, and a pair of holes 48 through which extend a pair of screws 50.

The suction cups 22 each have a cup portion 52 from the center of which extends a stem 54. Each suction cup 22 includes a release tab 56 at an edge of the cup portion 52. An upper suction cup 22*a* is positioned with the release tab 56 extending toward the top end cap 24 and the lower suction cup 22*b* is positioned with the release tab 56 extending toward the bottom end cap 26.

Figure 3:
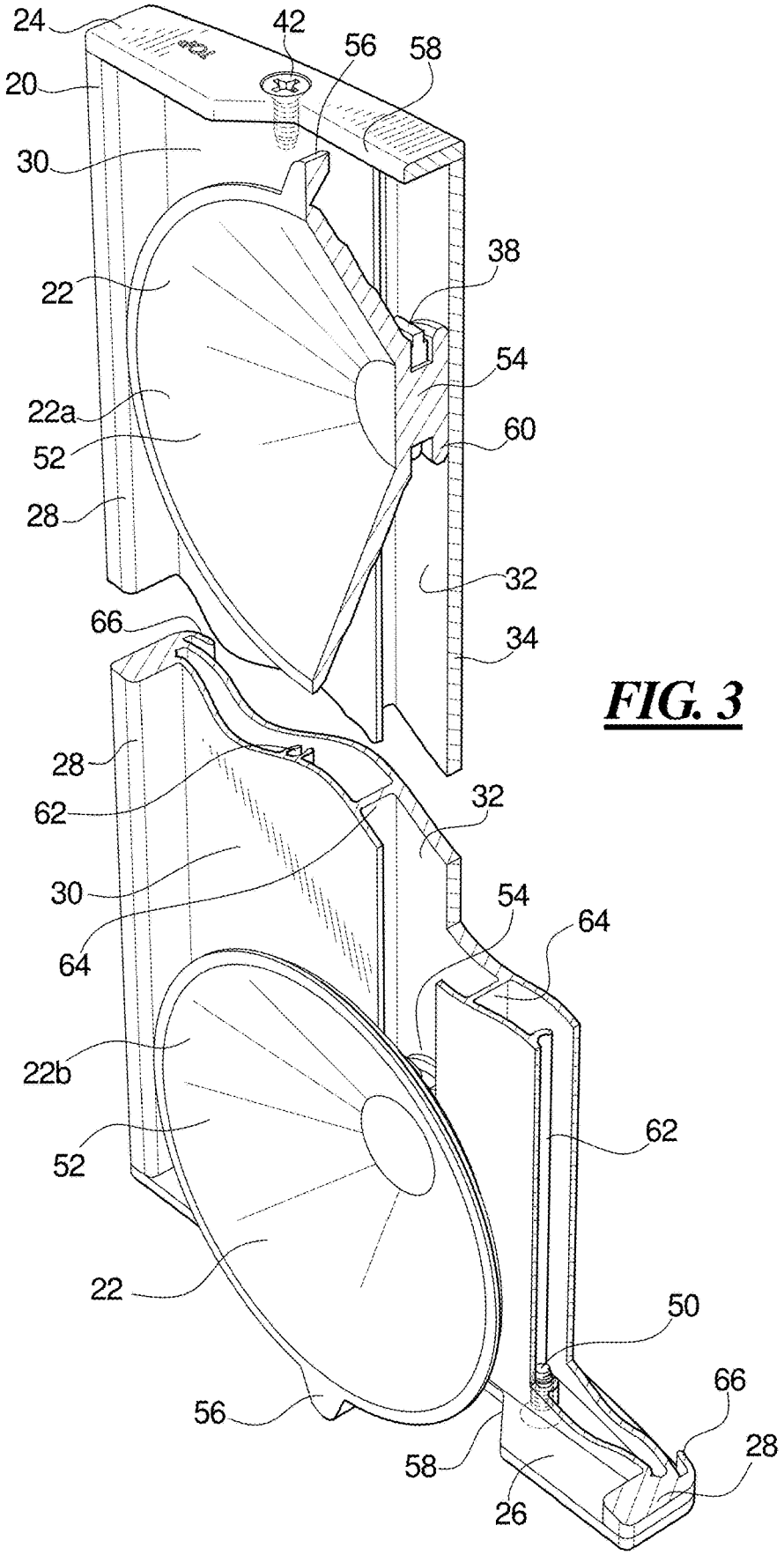
FIG. 3 is a fragmentary perspective view from the top, back, left side showing suction cups mounted in the panel body.

In FIG. 3, the suction cups 22 are positioned with the stem 54 of each in the center slot 32. The cup portions 52 of the suction cups 22 are enclosed within a space formed by the back panel 30, the side walls 28 and the top and bottom end caps 24 and 26, as well as the surface 12 to which the advertising panel is attached. The end caps 24 and 26 each have cut out portions 58 at a center back of the end caps. The cut out portions 58 provide clearance for an edge of the suction cups 22. The release tabs 56 extend from the enclosed space at the clearance provided by the cut out portions 58. The cut out portions 58 provide clearance for the suction cup 22 expand as it is pressed into place on the surface 12.

In the cut-away view of the upper suction cup 22*a*, one of the arms 38 is visible engaging the stem 54 of the suction cup 22*a*. The stem 54 of the suction cup 22 has a button portion 60 at the end of the stem 54 that includes flanges which define channels into which the arms 38 engage to hold the suction cup 22 in the center slot 32. The button portion 60 is held against or at least closely adjacent to a back surface of the front panel 34. The arms 38 ensure that the suction cup 22 is maintained in a position with the cup portion enclosed within the space behind the panel and with the release tabs 56 extending from behind the panel. As will be shown, the arms 38 and 46 maintain both the translational positions of the suction cups 22 as well as the rotational positions of the suction cups 22. The positions of the suctions cups 22 are maintained while providing a low profile construction.

The screw 42 holds the top end cap 24 to the panel body 20. The screw 50 holds the bottom end cap 26 to the opposite end of the panel body 20. The screw 50 is threaded into a screw boss 62 that is formed in the extruded panel body 20 between the back panel 30 and the front panel 34. One half of the screw boss 62 is shown in the cut-away to the lower right side of the figure. Both halves of the other screw boss 62 are shown in cross section near the center of the figure.

The cut-away view also reveals channel side walls 64 that extend from the back panel 30 to the front panel 34 on either side of the center slot 32. A display securing lip 66 is provided extending from the front panel 34 at the side walls 28.

Figure 4:
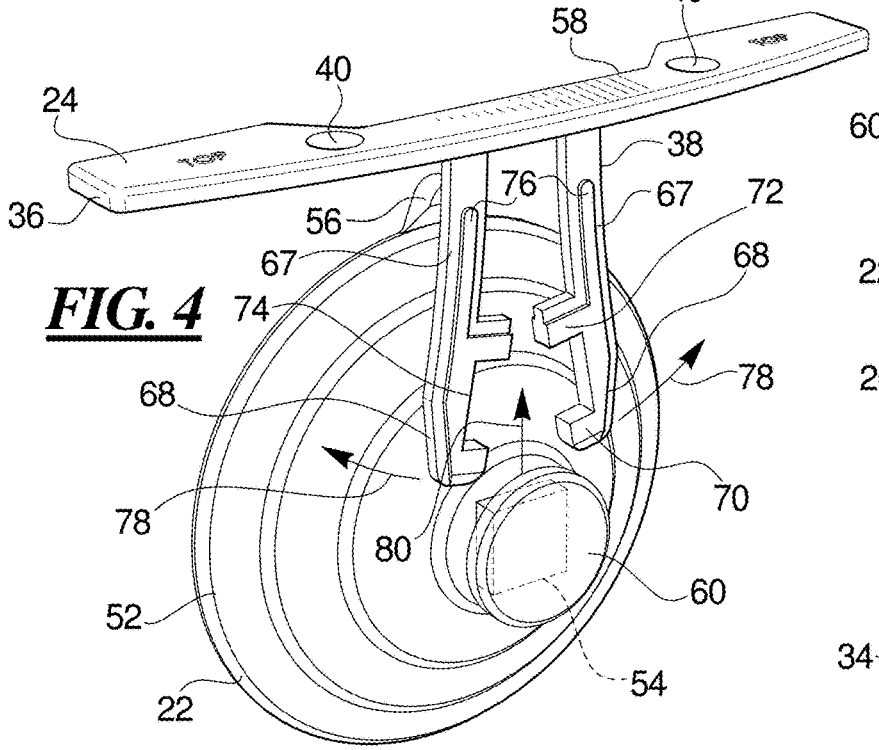
FIG. 4 is an exploded view of the top end cap and suction cup showing the suction cup being mounted in the arms of the end cap.

In FIG. 4, the end cap 24 is shown prior to being inserted into the panel body 20. The end cap 26 has a similar construction. The planar top portion 36 includes the cutout portion 58 to accommodate the cup portion 52 and release tab 56 of the suction cup 22. The arms 38 extend from the planar top portion 36 and are disposed generally parallel to one another. Each arm 38 includes a linear portion 67 extending from the planar top portion 36 and a taper 68 at the outside edge adjacent the free end of the arm 38. The free end of each arm 38 includes a first inwardly directed finger 70. Spaced from the first inwardly directed finger 70 along the arm 38 is a second inwardly directed finger 72. The inwardly directed fingers 70 and 72 of the two arms 38 extend toward one another. A square grasping portion 74 is formed by the ends of the arms 38 and the fingers 70 and 72 of the two arms 38. In the illustrated embodiment, the arms 38 have reinforcing ridges 76 on the forward and rear facing surfaces of each arm. The reinforcing ridges 76 extend from the free ends along the arms 38 and along both fingers 70 and 72, but end short of the planar cap portion 36 by a predetermined distance. The reinforcing ridges 76 strengthen the arms 38 to that they resist flexing. The absence of the reinforcing ridges 76 for a distance near the planar cap portion 36 allows the arms 38 to flex for insertion of the suction cup 22.

In FIG. 4, the arms 38 are being flexed away from one in the direction of the arrows 78. With the arms 38 flexed, the stem 54 of the suction cup 22 is inserted between the arms 38 as shown by the arrow 80. The stem 54 is of a square shape corresponding to the size and shape of the square grasping portion 74. After positioning the stem 54 between the arms 38, tension on the arms 38 is released so that the square grasping portion 74 fits around the square stem 54 and into the space between the button portion 60 and the cup portion 52 of the suction cup 22. The square stem 54 in the square grasping portion 74 prevents the suction cup 22 from rotating. The end caps 24 and 26 and the arms 38 may be formed of a strong yet flexible material such as nylon.

The release tab 56 is aligned with the square stem 54 at a center of one side of the square stem 54. The square grasping portion 74 is configured so that the release tab 56 extend beyond the planar cap portion 36 when the suction cup 22 is grasped in the arms 38. The arms 38 are of a length so that most or all of the cup portion 52 of the suction cup 22 is behind the panel body 20 and the release tab 56 extends from behind the end thereof. The suction cup 22 is maintained in a translational position and a rotational position to provide access to the release tab 56.

It is possible to position the suction cup 22 in any of four positions with the release tab 56 extending from the edge at any of four cardinal directions. In any position other than with the release tab 56 extending beyond the end cap 24, the user may be unable to reach the release tab 56 to release the suction cup from a mounting surface 12.

It is contemplated that the suction cup 22 could have multiple release tabs in two, three or four directions to provide an accessible release tab regardless of the orientation of the suction cup in the arms 38. It is contemplated to provide other shapes of stems 54 and other shapes of grasping portions 74 which maintain the rotational position of the suction cup 22. For example, a shape of stem and grasping portion that only engages when the release tab is in the desired position and that does not engage in other positions may be provided. Examples may include a trapezoid, keystone, or other shape.

Figure 5:
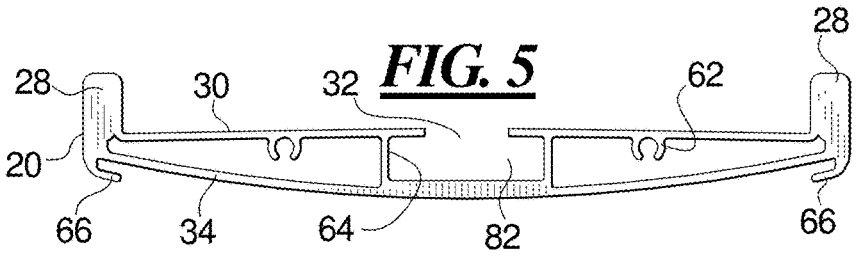
FIG. 5 is an end plan view of the panel body.

FIG. 5 shows the panel body 20 in end view. The panel body 20 of certain embodiments is an extrusion having an identical cross section along its length, although other configurations are possible. Because the extruded panel body 20 has the same shape along its length, the panel body 20 may be cut to any length desired and may still accept the end caps and suction cups. In certain examples, the panel body 20 is 14 inches from top to bottom, but in other examples it may be 7 inches long or any other length as desired. The panel body 20 may be formed as a rectangular or square by cutting off a desired length of the extrusion. The extruded panel body 20 may be formed of aluminum or plastic. In certain examples, the panel body 20 is formed of anodized aluminum in a deluxe version and of plastic in a regular version.

The channel side walls 64 define a channel 82 into which fits the arms 38 of the end caps 24 and 26. The channel side walls 64 are spaced apart a distance to permit the arms 38 to fit between the side walls 64 but which prevent the arms from flexing outward and which prevent the suction cup 22 from rotating while the arms 38 are in the channel 82. The stem 54 and the button portion 60 are enclosed within the channel 82 and the cup portion 52 extends through the center slot 32 and is outside of the channel 82.

The back panel 30 is flat or nearly flat and the front panel 34 is curved, providing a space between the back panel 30 and front panel 34 in which the channel 82 and the screw bosses 62 are located. The display securing lips 66 are provided on opposite sides of the curved front panel 34 and are configured for holding the opposite edges of advertising material such as a paper, card, plastic sheet or other material or display. An option includes a clear plastic cover that extends over the advertising material and is likewise engaged behind the display securing lips 66. As an alternative, the advertising material may have a clear coating or other protective coating. The side walls 28 extend toward the rear from the back panel 30 to define an enclosing space within which the suction cups 22 are provided when the advertising panel 10 is affixed to a surface 12. It is contemplated that the curved front panel 34 may be flat, convex, concave, or of other shapes such as wavy or serpentine. The advertising panel 10 is rectangular or may be other shapes including square, oval, round, octagon, hexagon, or other regular and irregular shapes.

Figure 6:
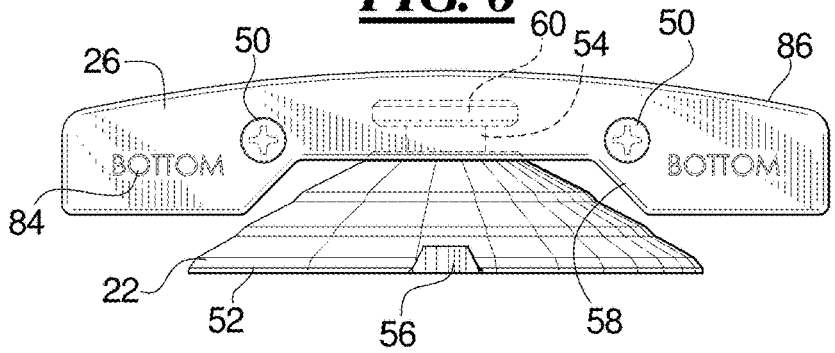
FIG. 6 is a bottom plan view of the advertising panel showing the bottom end cap and the bottom suction cup.

In FIG. 6, the bottom end cap 26 is shown as mounted on the advertising panel 10 with the suction cup 22 in place. The bottom end cap 26 is provided with markings 84 to indicate to the user that this is the bottom of the advertising panel 10. Markings are also provided on the top end cap 24 to indicate the top of the advertising panel 10. The markings to indicate the top and bottom of the advertising panel 10 do not limit the position or orientation in which the advertising panel 10 may be mounted or used. The top and bottom end caps 24 and 26 differ in that the bottom end cap 26 is configured to retain paper, card, or plastic advertising material and the optional clear plastic cover in the display securing lips 66, whereas the top end cap 24 is configured to permit the paper, card, or plastic advertising material and the optional clear plastic cover to be removed from between the display securing lips 66 by sliding the advertising material out of the advertising panel 10. A front edge 86 of the bottom end cap 26 is curved to match the curve of the front panel 34. The bottom panel front edge 86 extends beyond the front panel 34. The reader will note that FIGS. 5 and 6 are inverted with respect to one another.

The screws 50 are inserted into holes in the bottom end cap 26 and engage into the screw bosses 62 in the panel body 20. The suction cup 22 cannot be rotated out of the position with the release tab 56 extending through the recess 58 when the end cap 24 or 26 is fastened to the panel body 20.

Figure 7:
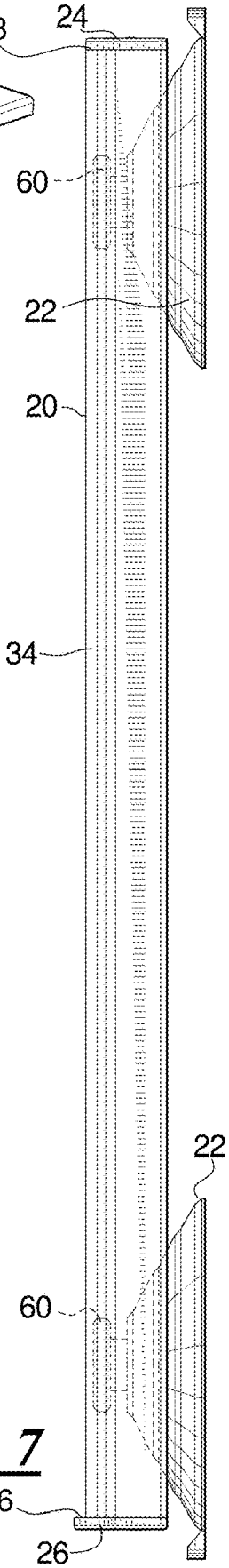
FIG. 7 is a side elevational view showing the advertising panel in an unmounted position.

FIG. 7 shows a side view of the advertising panel 10 detached from the surface. The suction cups 22 are in their non-compressed shape. When compressed, the suction cups 22 may be nearly or completely within the space formed by the side walls 28 and out of view. The top end cap 24 has a front edge 88 that is flush with the front panel 34. The bottom end cap 26 has the bottom panel front edge 86 extending beyond the front panel 34.

Turning to FIG. 8, the top end panel 24 has the front edge 88 set back from the front edge 86 of the bottom end panel 26 so that advertising material 90 or other information, other material, or other display may be inserted and removed from the advertising panel 10 without removing the end caps 24 or 26. The advertising material 90 is sized to fit into the display securing lips 66. The arm 38, stem 54 and button portion 60 within the channel between the channel side walls 64 as shown in phantom. The end cap 24 also has indicia 92, the indicia 92 indicating to the user that this is the top of the advertising panel 10. The bottom panel front edge 86 and the display securing lips 66 are to prevent the advertising material 90 from slipping out of the advertising panel 10 when in the mounted position.

FIG. 9 shows the advertising material 90 being inserted or removed from the advertising panel 10. The advertising material 90 is a flat sheet of material, such as paper, card, plastic, plastic coated paper or card, film, foil, or other material that has been curved to fit between the display securing lips 66. The advertising material 90 may be slid on the front of the panel body 20 past the top end cap 24 in the direction of arrow 94 until the advertising material 90 reaches the edge 86 of the bottom end cap 26. Removal may be accomplished by sliding the advertising material 90 in the opposite direction. For flexible advertising material or other display, it is possible to bend the advertising material 90 into a curve and insert the edges behind the display securing lips 66 without sliding on the panel body 20 or to bend the advertising material 90 to remove the advertising material 90 from behind the display securing lips 66. In certain embodiments, a clear protective layer such as a clear plastic is placed over the advertising material 90 and may be slid into and out of position with the advertising material 90. The clear protective layer may be slid into position or removed separately from the advertising material 90. Or the clear protective layer may be flexed for insertion behind the display securing lips 66 or for removal.

Figures 10, 11:
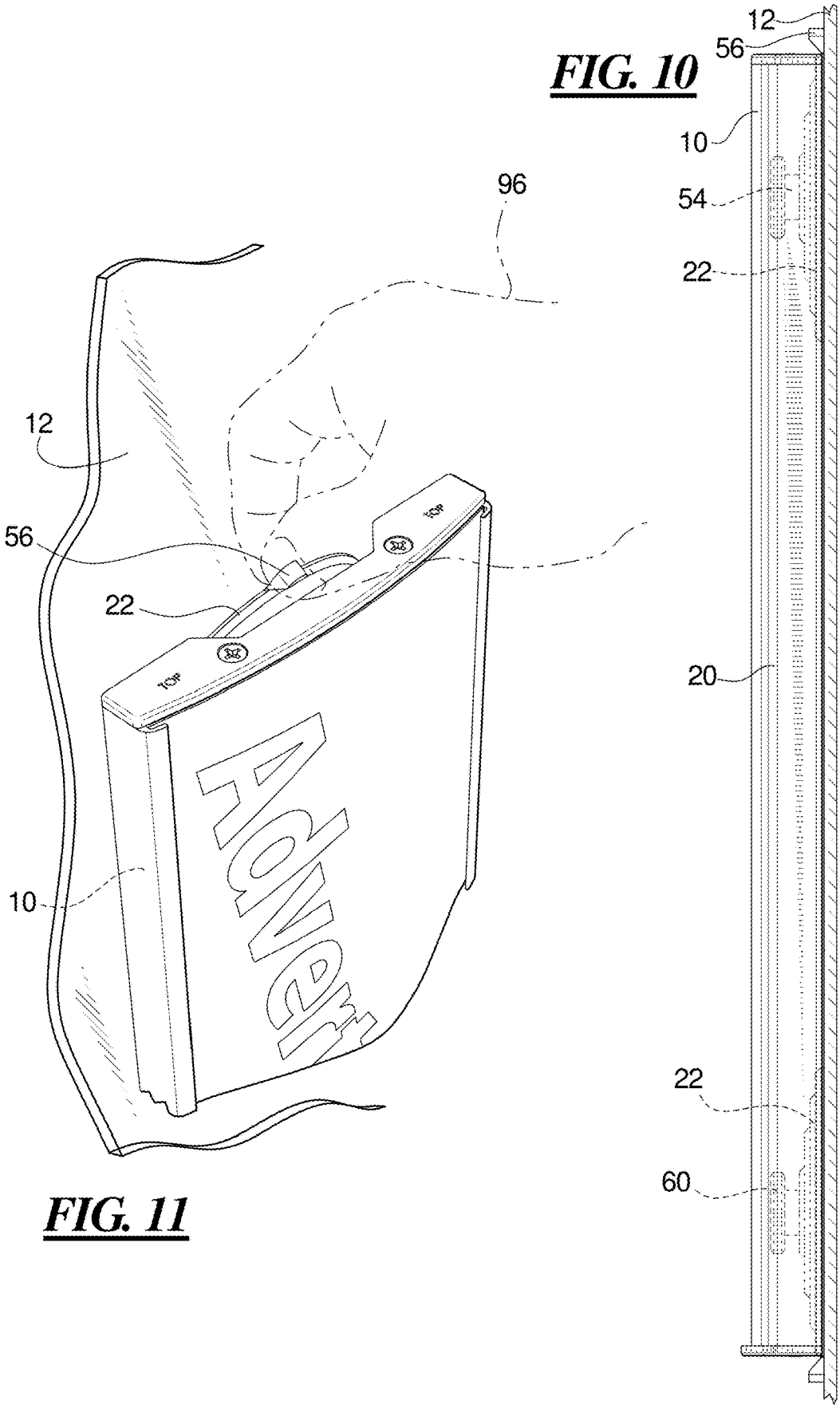
FIG. 10 is a side elevational view of the advertising panel mounted to a surface.
FIG. 11 is a fragmentary perspective view of the advertising panel being removed from a surface.

In FIG. 10, the advertising panel 10 is fastened to the surface 12. The suction cups 22 are forced into a flattened shape, pulling the back edge of the advertising panel 10 against the surface 12 or closely spaced from the surface 12. The suction cups 22 of certain embodiments are low profile suction cups having short stems 54 and button portions 60 so that they fit within and are enclosed by the advertising panel 10 when attached to the surface 12. The advertising panel 10 itself has a low profile when affixed to the surface 12. The low profile advertising panel 10 does not interfere with access to the door handle 14 (see FIG. 1) or interfere with shoppers moving along the store aisles.

Access to the suction cups 22 would be impossible if not for the release tabs 56 extending beyond the end caps 24 and 26. The close position between the panel 10 and the surface 12 provides a secure and stable attachment position with little or no vibration or wobble. The advertising panel 10 provides an attractive, finished appearance when attached to the surface 12. The large diameter suction cups 22 provide a strong attachment force to the surface 12 which would be difficult to remove if not for the release tabs 56.

Because the suction cups 22 expel a quantity of air from the cup portion 52 when being compressed into a fastening position, a cushion of escaping air is formed between the surface 12 and the suction cup 22 prior to attachment. The escaping air cushion results in the suction cups 22 having a tendency to slide laterally as they are being attached. The larger the suction cup 22, the greater the quantity of escaping air and the greater the likelihood of lateral movement. On the other hand, the larger suction cups provide strong securement to the surface 12. A person seeking to mount the advertising panel 10 on a glass door, window, or other smooth non-porous surface may find after a mounting attempt that the advertising panel 10 is secured in a crooked, laterally displaced, or otherwise not in the desired position. It is even possible that a user may make several attempts at fastening the suction cups before the advertising panel 10 is fastened in a desired position, for example, if the user presses the panel 10 into place without guarding against lateral movement.

In FIG. 11, a user 96 has attached the advertising panel 10 to a glass surface 12 but the panel 10 may have slid or otherwise moved to an different position from its intended position as the suction cups 22 where being pressed into place. The figure may also show an advertising panel 10 that has been mounted on the glass surface 12 in the desired position, but the user wishes to clean the surface 12, to reposition the advertising panel 10 to a new location, or remove it for another reason. To release the secured advertising panel 10, a user 96 grasps the release tab 56 and pulls away from the surface 12, allowing air to enter the space between the cup portion 52 and the surface 12. This releases the suction and permits the advertising panel 10 to be removed from the surface 12. Both suction cups 22 have release tabs 56 that extend beyond the respective end caps 24 and 26. A user 96 seeking to remove or reposition the advertising panel 10 releases the suction by both suction cups 22 by pulling the release tabs 56 of both suction cups 22.

Figure 12:
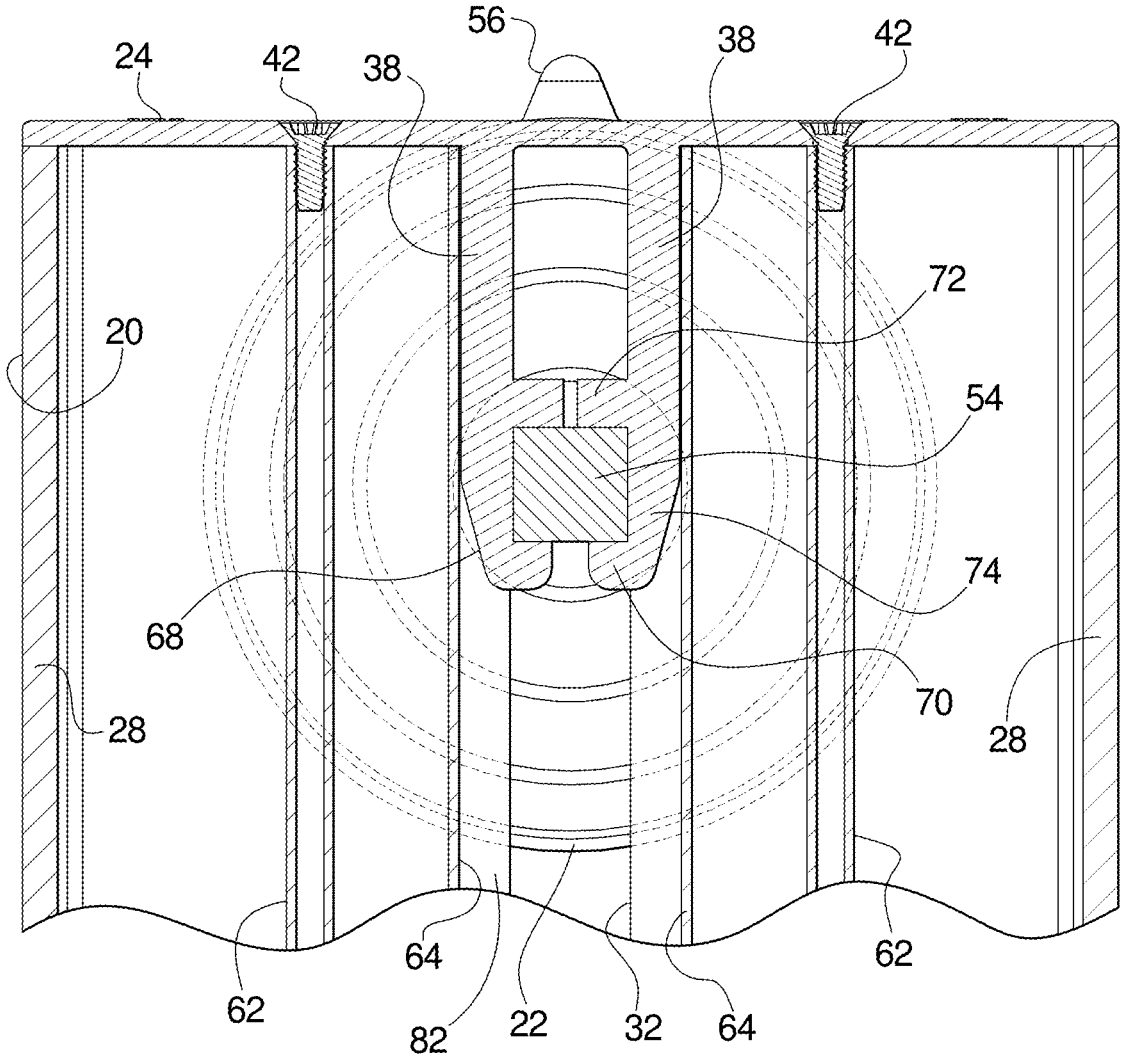
FIG. 12 is a cross sectional view along line XII-XII of FIG. 8 showing the end cap holding the suction cup in position in the panel body.

Lastly, in FIG. 12, a cross sectional view along line XII-XII of FIG. 8 shows the top end cap 24 mounted on the end of the panel body 20 using the screws 42. A cross sectional view through the bottom end cap 26 may appear identical. The screws 42 extend into the screw bosses 62 in the panel body 20. The arms 38 extend into the channel 82 formed by the channel side walls 64. The outer edges of the arms 38 bear against the channel side walls 64 or are closely adjacent to the channel side walls 64. The channel side walls 64 prevent the arms 38 from flexing outward and thereby prevent the stem 54 of the suction cup 22 from rotating in the square grasping portion 74 formed by the ends of the arms 38 and the first and second inwardly directed fingers 70 and 72. The ends of the arms 38 are tapered along their outer edges at tapers 68. The tapers 68 enable the arms 38 with the suction cup 22 held therein to be slid into the channel 82 between the channel side walls 64. The combination of the square stem 54, the square grasping portion 74 between the two arms 38, and the channel side walls 64 having a width corresponding to the width of the arms 38 while holding the suction cup 22 prevent the suction cup 22 from rotating and maintains the release tab 56 in a position where it is accessible to the user 96.

The arms 38 are of a length that maintain the release tab 56 in a position extending beyond the end cap 24 or 26. For example, the arms 38 may be of a length that corresponds to a radius of the suction cup 22. The arms 38 can have a length of the suction cup radius when the suction cup is in a relaxed and unfastened state such as shown in FIGS. 6, 7 and 8, or can have a length corresponding to the radius of the suction cup in the flattened and fastened state such as shown in FIG. 10, or some other length, such as a between the radius of the relaxed and flattened states.

The side walls 28 are spaced apart from one another a distance such that the suction cup 22 is enclosed between the side walls 28 when the advertising panel 10 is attached to the surface 12. The center slot 32 of the panel body 20 has a width at least as wide as a dimension of the square stem 54. The square stem 54 and the button portion 60 of the suction cup 22 are within the channel 82 and the cup portion 52 is outside the channel 82, the parts being connected through the center slot 32. The suction cup 22 may include a shaped portion configured to slide along and extend through the center slot 32 or may have a square stem 54 of a length so that the square stem 54 is both held in the square grasping portion 74 of the arms 38 and extends through the center slot 32 of the panel body 20.

Thus, there has been shown and described an advertising panel for attaching to a glass door or other non-porous surface includes a panel body with a front surface configured for holding advertising material. End caps are mounted on the ends of the panel body. Each end cap includes two arms extending into a channel in the panel body. The arms include grasping portions that receive a square stem of a suction cup. The suction cup extends out of the channel at a slot that is open at the back of the panel body. The cup portion of the suction cups is enclosed behind the panel body when attached to the surface. A release tab of each suction cup extends from the panel body at cut out portions of the end caps. The arms are of a length to maintain the release tabs at a position extending from the end caps and prevent rotation of the suction cups.

The present method and apparatus includes various aspects. In a first aspect, a method for attaching and releasing an advertising panel to a surface, comprising: pressing the advertising panel against the surface so that at least one suction cup on a back of the advertising panel is compressed and adhered to the surface; enclosing a cup portion of the at least one suction cup within an enclosed space between the advertising panel and the surface while the suction cup is adhered to the surface; maintaining a release tab on the suction cup in a position extended from the enclosed space when the suction cup is adhered to the surface; and releasing the suction cup from an adhered condition on the surface by manipulating the release tab.

In a second aspect according to the first aspect, wherein only the release tab of the suction cup extends from the enclosed space.

In a third aspect according to the first aspect, preventing rotation of the suction cup relative to the advertising panel.

In a fourth aspect according to the third aspect, wherein the preventing rotation includes: gripping a non-circular stem of the suction cup by at least one arm of an end cap, and receiving the arm of the end cap in a channel of a panel body.

In a fifth aspect according to a fourth aspect, wherein the gripping includes gripping the stem of the suction cup between two arms of the end cap; and wherein the receiving includes receiving the two arms into the channel, the channel having a width corresponding to a width of the two arms.

In a sixth aspect according to the fourth aspect, wherein the non-circular step of the suction cup is a square stem, and wherein the at least one arm includes a square grasping portion.

In a seventh aspect, an advertising panel for mounting on a surface, comprising: a panel body having a first end and a second end, the panel body including a front panel configured for holding advertising material, the panel body defining a channel; a first end cap fastened to the first end of the panel body, the first end cap having at least one arm including a grasping portion; a suction cup having a stem configured to fit the grasping portion of the at least one arm, the suction cup including a release tab; and the end cap being fastened on the first end of the panel body with the at least one arm extending into the channel and the suction cup stem fit to the grasping portion of the at least one arm, the release tab extending from the panel body when the panel body is secured to a surface using the suction cup.

In an eighth aspect according to the seventh aspect, wherein the stem of the suction cup is of a non-circular shape and wherein the grasping portion of the at least one arm is of a corresponding non-circular shape so that the suction cup is prevented from rotating when held in the grasping portion.

In a ninth aspect according to the eighth aspect, wherein the stem of the suction cup is square and wherein the grasping portion includes a square grasping portion configured to engage the stem so that the suction cup is prevented from rotating when held in the grasping portion.

In a tenth aspect according to the eighth aspect, wherein the at least one arm includes first and second arms extending parallel to one another from the end cap, the first and second arms including grasping portions configured to receive the stem of the suction cup.

In an eleventh aspect according to the tenth aspect, wherein the first and second arms each include a taper at a free end of the respective arms.

In a twelfth aspect according to the tenth aspect, wherein the channel in the panel body is of a width corresponding to a width of the first and second arms to receive the arms in the channel and prevent rotation of the suction cup in the arms.

In a thirteenth aspect according to the seventh aspect, a second end cap fastened to the second end of the panel body, the second end cap having at least one arm including a grasping portion; and a second suction cup having a stem configured to fit the grasping portion of the at least one arm of the second end cap, the suction cup including a release tab.

In a fourteenth aspect according to the seventh aspect, wherein the first end cap includes a cut out portion from which extends the release tab of the suction cup when the advertising panel is affixed to a surface.

In a fifteenth aspect according to the seventh aspect, wherein the grasping portion includes first and second fingers extending from the at least one arm.

In a sixteenth aspect according to the seventh aspect, wherein the at least one arm includes a reinforcing ridge extending along the at least one arm, the reinforcing ridge having a first end at a free end of the at least one arm and having a second end spaced from the end cap, so as to provide a flexible portion of the at least one arm adjacent to the end cap.

In a seventeenth aspect according to the seventh aspect, side walls extending form the panel body toward a surface to which the advertising panel is attached, the side walls enclosing the at least one suction cup.

In an eighteenth aspect according to the seventh aspect, wherein the front panel is curved and further comprising: display securing lips on opposite sides of the curved front panel.

In a nineteenth aspect according to the seventh aspect, a second end cap fastened at a second end of the panel body, the second end cap including a forward projecting edge extending beyond the front panel for engaging advertising material mounted on the front panel, the first end cap having a forward edge flush with the front panel.

In a twentieth aspect, an advertising panel for mounting on a surface, comprising: a panel body having a first end and a second end, the panel body including a front panel configured for holding advertising material, the panel body defining a channel; a first end cap fastened to the first end of the panel body, the first end cap having at least one arm including a grasping portion; a suction cup having a stem configured to fit the grasping portion of the at least one arm, the suction cup including a release tab; the end cap being fastened on the first end of the panel body with the at least one arm extending into the channel and the suction cup stem fit to the grasping portion of the at least one arm, the release tab extending from the panel body when the panel body is secured to a surface using the suction cup; the stem of the suction cup being is of a non-circular shape and wherein the grasping portion of the at least one arm is of a corresponding non-circular shape so that the suction cup is prevented from rotating when held in the grasping portion; the at least one arm including first and second arms extending parallel to one another from the end cap, the first and second arms including grasping portions configured to receive the stem of the suction cup, the first and second arms each including a taper at a free end of the respective arms, the channel in the panel body is of a width corresponding to a width of the first and second arms to receive the arms in the channel and prevent rotation of the suction cup in the arms, a second end cap fastened to the second end of the panel body, the second end cap having at least one arm including a grasping portion; a second suction cup having a stem configured to fit the grasping portion of the at least one arm of the second end cap, the suction cup including a release tab, the first end cap including a cut out portion from which extends the release tab of the suction cup when the advertising panel is affixed to a surface, the grasping portion includes first and second fingers extending from the at least one arm, the at least one arm includes a reinforcing ridge extending along the at least one arm, the reinforcing ridge having a first end at a free end of the at least one arm and having a second end spaced from the end cap, so as to provide a flexible portion of the at least one arm adjacent to the end cap, side walls extending form the panel body toward a surface to which the advertising panel is attached, the side walls enclosing the at least one suction cup, the front panel being curved and further comprising display securing lips on opposite sides of the curved front panel; and the second end cap including a forward projecting edge extending beyond the front panel for engaging advertising material mounted on the front panel, the first end cap having a forward edge flush with the front panel.

Although other modifications and changes may be suggested by those skilled in the art, it is the intention of the inventors to embody within the patent warranted hereon all changes and modifications as reasonably and properly come within the scope of their contribution to the art.

I claim:

1. An advertising panel for mounting on a surface, comprising:

a panel body having a first end and a second end, the panel body including a front panel configured for holding advertising material or other display, the panel body defining a channel;

a first end cap fastened to the first end of the panel body, the first end cap having at least one arm including a grasping portion;

a suction cup having a stem configured to fit the grasping portion of the at least one arm, the suction cup including a release tab; and the end cap being fastened on the first end of the panel body with the at least one arm extending into the channel and the suction cup stem fit to the grasping portion of the at least one arm, the release tab extending from the panel body when the panel body is secured to a surface using the suction cup.

2. The advertising panel as claimed in claim 1, wherein the stem of the suction cup is of a non-circular shape and wherein the grasping portion of the at least one arm is of a corresponding non-circular shape so that the suction cup is prevented from rotating when held in the grasping portion.

3. The advertising panel as claimed in claim 2, wherein the stem of the suction cup is square and wherein the grasping portion includes a square grasping portion configured to engage the stem so that the suction cup is prevented from rotating when held in the grasping portion.

4. The advertising panel as claimed in claim 2, wherein the at least one arm includes first and second arms extending parallel to one another from the end cap, the first and second arms including grasping portions configured to receive the stem of the suction cup.

5. The advertising panel as claimed in claim 4, wherein the first and second arms each include a taper at a free end of the respective arms.

6. The advertising panel as claimed in claim 4, wherein the channel in the panel body is of a width corresponding to a width of the first and second arms to receive the arms in the channel and prevent rotation of the suction cup in the arms.

7. The advertising panel as claimed in claim 1, further comprising:

a second end cap fastened to the second end of the panel body, the second end cap having at least one arm including a grasping portion; and a second suction cup having a stem configured to fit the grasping portion of the at least one arm of the second end cap, the suction cup including a release tab.

8. The advertising panel as claimed in claim 1, wherein the first end cap includes a cut out portion from which extends the release tab of the suction cup when the advertising panel is affixed to a surface.

9. The advertising panel as claimed in claim 1, wherein the grasping portion includes first and second fingers extending from the at least one arm.

10. The advertising panel as claimed in claim 1, wherein the at least one arm includes a reinforcing ridge extending along the at least one arm, the reinforcing ridge having a first end at a free end of the at least one arm and having a second end spaced from the end cap, so as to provide a flexible portion of the at least one arm adjacent to the end cap.

11. The advertising panel as claimed in claim 1, further comprising:

side walls extending from the panel body toward a surface to which the advertising panel is attached, the side walls enclosing the at least one suction cup.

12. The advertising panel as claimed in claim 1, wherein the front panel is curved and further comprising: display securing lips on opposite sides of the curved front panel.

13. The advertising panel as claimed in claim 1, further comprising:

a second end cap fastened at a second end of the panel body, the second end cap including a forward projecting edge extending beyond the front panel for engaging advertising material or other display mounted on the front panel, the first end cap having a forward edge flush with the front panel.

14. An advertising panel for mounting on a surface, comprising:

a panel body having a first end and a second end, the panel body including a front panel configured for holding advertising, the panel body defining a channel;

a first end cap fastened to the first end of the panel body, the first end cap having at least one arm including a grasping portion;

a suction cup having a stem configured to fit the grasping portion of the at least one arm, the suction cup including a release tab;

the end cap being fastened on the first end of the panel body with the at least one arm extending into the channel and the suction cup stem fit to the grasping portion of the at least one arm, the release tab extending from the panel body when the panel body is secured to a surface using the suction cup;

the stem of the suction cup being is of a non-circular shape and wherein the grasping portion of the at least one arm is of a corresponding non-circular shape so that the suction cup is prevented from rotating when held in the grasping portion;

the at least one arm including first and second arms extending parallel to one another from the end cap, the first and second arms including grasping portions configured to receive the stem of the suction cup, the first and second arms each including a taper at a free end of the respective arms;

the channel in the panel body is of a width corresponding to a width of the first and second arms to receive the arms in the channel and prevent rotation of the suction cup in the arms;

a second end cap fastened to the second end of the panel body, the second end cap having at least one arm including a grasping portion;

a second suction cup having a stem configured to fit the grasping portion of the at least one arm of the second end cap, the suction cup including a release tab;

the first end cap including a cut out portion from which extends the release tab of the suction cup when the advertising panel is affixed to a surface;

the grasping portion includes first and second fingers extending from the at least one arm;

the at least one arm includes a reinforcing ridge extending along the at least one arm, the reinforcing ridge having a first end at a free end of the at least one arm and having a second end spaced from the end cap, so as to provide a flexible portion of the at least one arm adjacent to the end cap;

side walls extending form the panel body toward a surface to which the advertising panel is attached, the side walls enclosing the at least one suction cup;

the front panel being curved and further comprising display securing lips on opposite sides of the curved front panel; and the second end cap including a forward projecting edge extending beyond the front panel for engaging advertising material or other display mounted on the front panel, the first end cap having a forward edge flush with the front panel.

15. A method for attaching and releasing an advertising panel to a surface, comprising:

pressing the advertising panel against the surface so that at least one suction cup on a back of the advertising panel is compressed and adhered to the surface;

enclosing a cup portion of the at least one suction cup within an enclosed space between the advertising panel and the surface while the suction cup is adhered to the surface;

maintaining a release tab on the suction cup in a position extended from the enclosed space when the suction cup is adhered to the surface;

releasing the suction cup from an adhered condition on the surface by manipulating the release tab; and preventing rotation of the suction cup relative to the advertising panel, wherein the preventing rotation includes:

gripping a non-circular stem of the suction cup by at least one arm of an end cap, and receiving the arm of the end cap in a channel of a panel body.

16. The method as claimed in claim 15, wherein the gripping includes gripping the stem of the suction cup between two arms of the end cap; and wherein the receiving includes receiving the two arms into the channel, the channel having a width corresponding to a width of the two arms.

17. The method as claimed in claim 15, wherein the gripping includes gripping a non-circular stem of the suction cup is a square stem, and wherein the at least one arm includes a square grasping portion.

* * * * *